US007653952B2

(12) United States Patent
Guo

(10) Patent No.: US 7,653,952 B2
(45) Date of Patent: Feb. 2, 2010

(54) BED WITH MOVABLE MATTRESS

(76) Inventor: Fuling Guo, 3156 Cedar Grove Dr., Fairfax, VA (US) 22031

( * ) Notice: Subject to any disclaimer, the term of this patent is extended or adjusted under 35 U.S.C. 154(b) by 346 days.

(21) Appl. No.: 11/443,216

(22) Filed: May 31, 2006

(65) Prior Publication Data

US 2007/0143923 A1 Jun. 28, 2007

Related U.S. Application Data

(60) Provisional application No. 60/752,493, filed on Dec. 22, 2005.

(51) Int. Cl.
*A61G 7/00* (2006.01)
*A61G 7/018* (2006.01)

(52) U.S. Cl. ..... 5/600

(58) Field of Classification Search ..... 5/608, 5/609, 607, 601, 600, 108, 109; 378/209
See application file for complete search history.

(56) References Cited

U.S. PATENT DOCUMENTS 4,761,000 A * 8/1988 Fisher et al. ..... 5/608
5,013,018 A * 5/1991 Sicek et al. ..... 5/601
6,094,760 A * 8/2000 Nonaka et al. ..... 5/601
6,155,976 A 12/2000 Sackner et al.
7,181,792 B2 * 2/2007 Nakamura et al. ..... 5/601
2005/0028280 A1 * 2/2005 Nakamura et al. ..... 5/601
2007/0143923 A1 * 6/2007 Guo ..... 5/608
2007/0143924 A1 * 6/2007 Guo ..... 5/608
2009/0185663 A1 * 7/2009 Gaines, Jr. ..... 378/209

* cited by examiner

*Primary Examiner*—Robert G Santos
(74) *Attorney, Agent, or Firm*—Birch, Stewart, Kolasch & Birch, LLP

(57) ABSTRACT

A bed including a support frame, a foundation configured to support the support frame, means for displacing the support frame in a longitudinal direction with respect to the foundation, and means for displacing the support frame in a transverse direction with respect to the foundation. In addition, a method for inducing sleep by providing the proper stimulation to the vestibular organs is also provided. The method includes providing a support member configured to support an individual, controlling the displacement of the support member in a longitudinal direction of the support member, and controlling the displacement of the support member in a transverse direction of the support member. The combined motion of the support member in both the longitudinal direction and the transverse is configured to induce sleep.

17 Claims, 10 Drawing Sheets

BED WITH MOVABLE MATTRESS

CROSS REFERENCE TO RELATED APPLICATIONS

This application claims the benefit of U.S. Provisional Application No. 60/752,493, filed Dec. 22, 2005, which is herein incorporated by reference.

BACKGROUND OF THE INVENTION

1. Field of the Invention

The invention relates generally to beds and more specifically, to a bed configured to oscillate in both a longitudinal and transverse direction.

2. Description of Related Art

A large portion of people complain that they have to lie down on a bed for a long time before they fall asleep; that they can not fall asleep again after they wake up during the night; or that they wake up early and can not fall asleep again in the early morning. According to statistics, one-fourth of the population suffers from insomnia; in adults over 76 year old, 29% of men and 37% of women have sleep problem. In addition, many people suffer from simple insomnia or other sleep problems caused by physical or mental diseases. Drugs used for insomnia have a certain limitation because of their side effects, which inhibit the action of the central nervous system for a certain period of time and can therefore affect a person's quality of life. They may also cause drug-dependence.

No one doubts that sleep is vitally important for human physical and mental health and therefore the sleep mechanism is an issue that is worth exploring and continues to be explored. Experiments involving lack of sleep suggest that sleep allows the body to rest and repair itself. Therefore, the invention of a new and effective hypnotherapy technology would be highly desirable.

The effect of some of the so-called hypnotherapies is questionable. One example is music hypnotherapy that relies on an aural stimulus, which only acts on the cochlear nerves and locally stimulates the cerebral cortex of the brain. Some special beds have been used in hospitals that have a special mattress and bed skeleton. However, the function of the bed is not for the treatment of insomnia but mainly for the prevention of bedsores and pneumonia in patients who are unconscious or who have difficulty changing their posture.

Traditional understanding of sleep in humans assumes that the quietness of the environment is an important factor. In conjunction with this assumption, is the belief that a generally steady sleep surface is also beneficial. However, this is an issue that merits further consideration, in fact it can be shown that a proper form and quantity of movement is an effective stimulation for promoting sleep. One example, which I call the cradle effect, is a child being rocked in a cradle or rocked by a parent in the parent's arms. Another example, which I call the trip effect, is when people fall asleep while traveling by carriage, car, ship or train. The third example is that sleepiness, likely to be caused by the motion of the car, is a major cause of serious accidents proved by traffic accident surveys (Department of Human Science, Loughborough University Tel: +44-1509-223091). In addition, people change position a few times before they lie down and try to sleep.

Vestibular organs including the utricle, the saccule and the semicircular canals are traditionally understood as balance sense organs that assist humans and animals in evaluating the position of the head relative to gravity and maintaining balance while carrying out normal activities. However, the vestibular organs are also sleep organs.

Based on study of sleep history, exquisite observation of human' life and continuously exploration of sleep mechanism, applicant thinks that sleep mechanism consists of two sub-mechanisms: the sleep initiation mechanism and the sleep maintenance mechanism. Sleep occurrence is a process of a consciousness state entering a sleep (we call none or very low level consciousness) state and is triggered by the sleep initiation mechanism. Sleep occurrence depends on conditions both from outside and inside of the body. That is, both the environment and some organs of the body control sleep initiation. As such, sleep occurrence is a conditioned reflex. Generally, the sleep maintenance mechanism is the natural, cerebral function program which is procedurally controlled by the brain although it is affected by conditions from inside and outside the body.

One aspect affecting sleep initiation is motion sensed by the body. The proper motion is a motion which simultaneously satisfies two conditions: (1) quality: causes continuous stimulation of vestibular organs, of which there are two forms: rhythmic motion and rhythm-less motion; (2) quantity: proper motion intensity which will not cause muscles, especially extremity muscles, to contract in an attempt to maintain body balance and excessive reaction of parasympathetic excitation. The proper motion gives appropriate stimulation to vestibular organs thereby promoting the occurrence of sleep.

Based the foregoing information, I have established a theory that the mechanism of sleep occurrence is a conditioned reflex controlled via the vestibular organs, which include the utricle, the saccule, and the semicircular canals, which are therefore sleep sense organs; and that the brainstem and basal forebrain form the sleep center. Proper motion causes the vestibular organs to send a sleep signal to the sleep center in the brainstem and the basal forebrain via the vestibular nerve; the neurons of the sleep center are activated and sleep onset is triggered.

Therefore, it is desirable to provide a new bed that moves in such a manner to promote the sleep initiation mechanism and the sleep maintenance mechanism by proper stimulation of the vestibular organs.

BRIEF SUMMARY OF THE INVENTION

According to one aspect of the present invention, an apparatus includes a foundation, a side-to-side assembly movably supported on the foundation, a support frame movably mounted on the side-to-side assembly, a first motion device connected to the side-to-side assembly, the first motion device configured to move the side-to-side assembly in a longitudinal direction with respect to the foundation, and a second motion device located on the side-to-side assembly, the second motion device being configured to move the support frame in a transverse direction with respect to the foundation. The combination of movement in the longitudinal direction and the transverse direction provides reciprocal movement of the support frame.

In a further aspect, the apparatus may include a control device configured to control both the first motion device and the second motion device to provide the reciprocal movement. The control device may control frequency of the reciprocal movement, amplitude of the reciprocal movement, and/or time period of the reciprocal movement. The control device may include control panel for users to set parameters of the reciprocal movement.

In another aspect, the first motion device may include an electric motor having a rotating shaft and a power transmission component connected between the rotating shaft and the side-to-side assembly. The power transmission component converts rotational movement of the rotating shaft into longitudinal displacement of the side-to-side assembly.

In yet another aspect, the second motion device may include an electric motor having a rotating shaft and a power transmission component connected between the rotating shaft and the support frame. The power transmission component converts rotational movement of the rotating shaft into transverse displacement of the support frame. The power transmission component may further include a driving wheel driven by the electric motor that contacts a lower surface of the support frame.

In a further aspect, the support frame may be pivotally mounted on the side-to-side assembly or may be linearly slidably mounted on the side-to-side assembly.

In another aspect, the apparatus may include at least one rail located on one of the side-to-side assembly and the support frame and at least one track assembly including a plurality of wheels located on the other of the side-to-side assembly and the support frame with the plurality of wheels being movable within the at least one rail. The at least one rail may be formed as an arcuate shape and/or the at least one track may be formed as an arcuate shape.

In a further aspect, the apparatus may include a pivot pin on one of the side-to-side assembly and support frame and a hole on the other of the side-to-side assembly and support frame where the hole is configured to receive the pivot pin. The support frame is configured to pivot with respect to the side-to-side assembly.

In a different aspect, the at least one rail includes a first rail and a second rail, the at least one track assembly includes a first track assembly and a second track assembly, and the first and second rails are generally straight.

In another aspect, the apparatus may include a mattress supported by the support frame.

In yet another aspect, the apparatus may include a longitudinal motion assembly supporting the side-to-side assembly on the foundation and the longitudinal motion assembly is configured to provide the longitudinal displacement of the side-to-side assembly.

In a further aspect, the apparatus may include a pair of rails located on one of the side-to-side assembly and the longitudinal motion assembly and a pair of track assemblies corresponding to the pair of rails located on the other of the side-to-side assembly and the longitudinal motion assembly. Each of the pair of track assemblies includes a plurality of wheels being movable within the corresponding rail.

According to a second aspect of the present invention, a bed includes a support frame, a foundation configured to support the support frame, means for displacing the support frame in a longitudinal direction with respect to the foundation, and means for displacing the support frame in a transverse direction with respect to the foundation.

In another aspect, the bed may include a mattress supported by the support frame.

In a different aspect, the means for displacing the support frame in a longitudinal direction and the means for displacing the support frame in the transverse direction may cooperate to displace the support frame in a plane generally parallel to an upper surface of the base.

In yet another aspect, the means for displacing the support in a longitudinal direction and the means for displacing in the transverse direction may cooperate to displace the support frame in the longitudinal direction and transverse direction at the same time.

According to a third aspect of the present invention, a method for inducing sleep by providing the proper stimulation to the vestibular organs includes providing a support member configured to support an individual, controlling the displacement of the support member in a longitudinal direction of the support member, and controlling the displacement of the support member in a transverse direction of the support member. The combined motion of the support member in both the longitudinal direction and the transverse is configured to induce sleep.

In another aspect, the combined motion may be generally in a single plane.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DETAILED DESCRIPTION OF THE INVENTION

Figure 1:
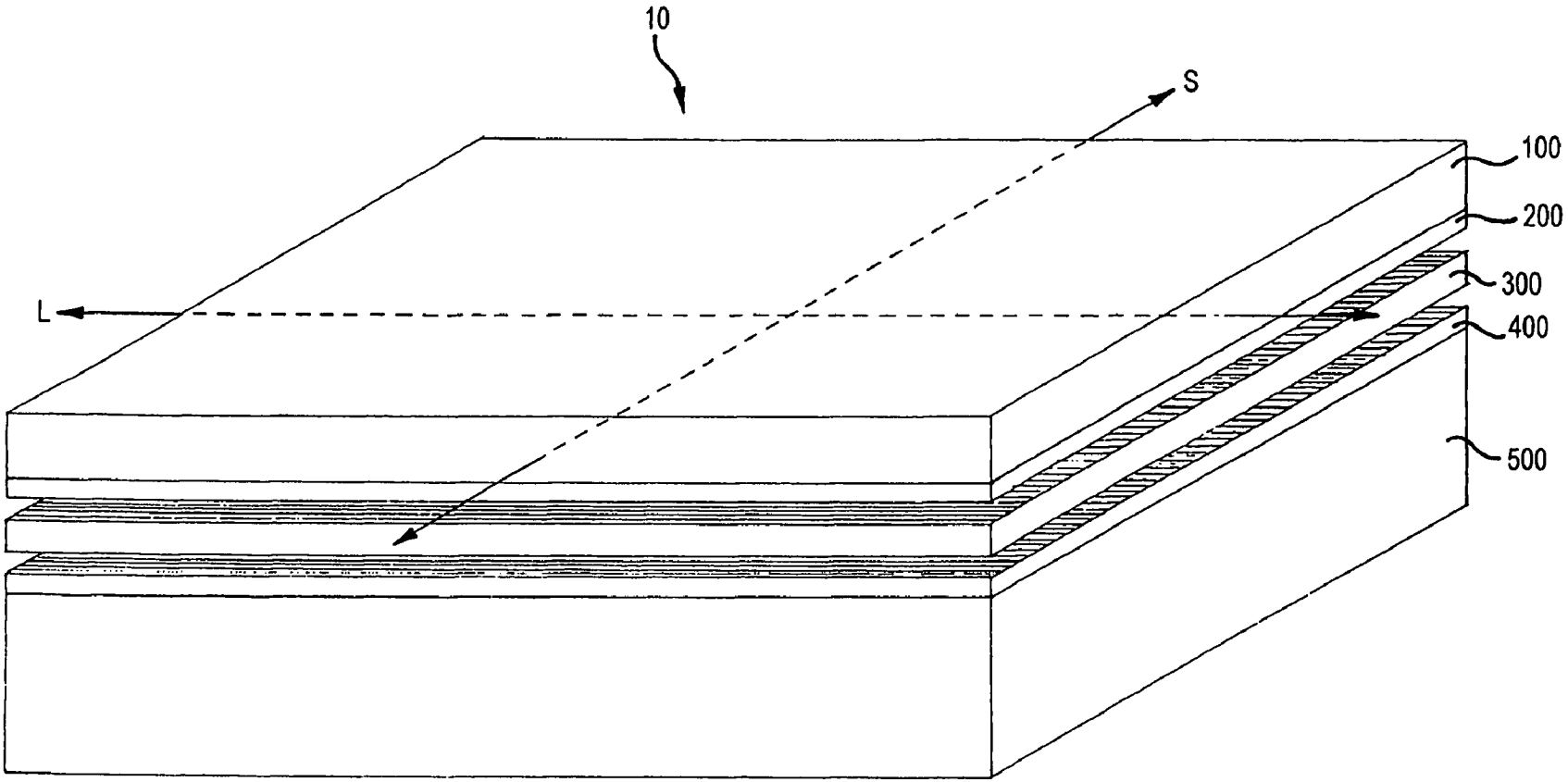
FIG. 1 is a perspective schematic view of an exemplary embodiment of the bed.

A first exemplary embodiment of a bed 10 is shown in FIGS. 1-6. As seen in FIG. 1, the bed 10 includes a mattress 100, a support frame 200, a side-to-side motion assembly 300 that supports frame 200, a longitudinal motion assembly 400 that supports the side-to-side motion assembly 300, and a pedestal or foundation 500. As shown, the bed 10 is designed to allow the mattress to be moved in a longitudinal direction L and/or a side-to-side direction T with respect to the foundation 500 and will be described in further detail below.

Proper control of the motion of the mattress will stimulate the vestibular organs and assist in the sleep initiative and sleep maintenance mechanisms.

Although the mattress 100, support frame 200, side-to-side motion assembly 300, the longitudinal motion assembly 400, and foundation 500 are shown as separate components, it is understood that one or more of these components can be combined into a single component. For example, mattress 100 and support frame 200 could be provided as a single reinforced mattress.

For purposes of this invention, the mattress 100 can be any conventional mattress, such as, for example, a foam mattress, an air mattress, a spring mattress, a water-filled mattress, or any other mattress that is designed to support a body in a supine position. As shown in FIG. 1, the mattress 100 is supported on a support frame 200.

Figure 2:
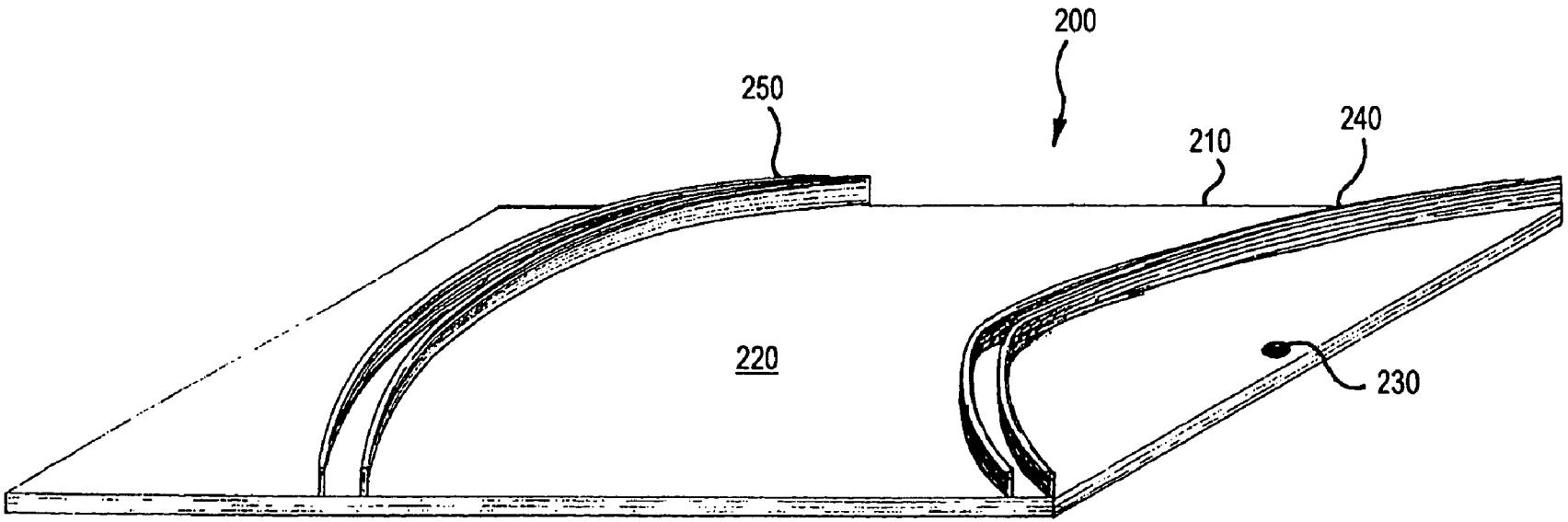
FIG. 2 is a perspective view of a first embodiment of a support frame for the bed of FIG. 1.

Support frame 200 is formed from any suitable planar material 210 that is strong enough to support the weight of a body or bodies plus the weight of mattress 100. The planar material 210 has an upper surface (not shown) that contacts mattress 100 and a lower surface 220. As seen in FIG. 2, a hole 230 is formed in the lower surface 220 near one end of the planar material 210. Preferably, the hole 230 does not extend completely through the planar material 210. A first rail 240 is attached to the lower surface 220 proximal the hole 230 and a second rail 250 is attached to the lower surface 220 distal the hole 230. As seen in FIG. 2, each of the rails 240, 250 are arcuate and the radius of curvature of the first rail 240 is less than the radius of curvature of the second rail 250. In this arrangement, the support frame 200 is configured to provide a side-to-side displacement with respect to the foundation 500 via an interaction between the support frame 200 and the side-to-side motion assembly 300.

Figure 3A:
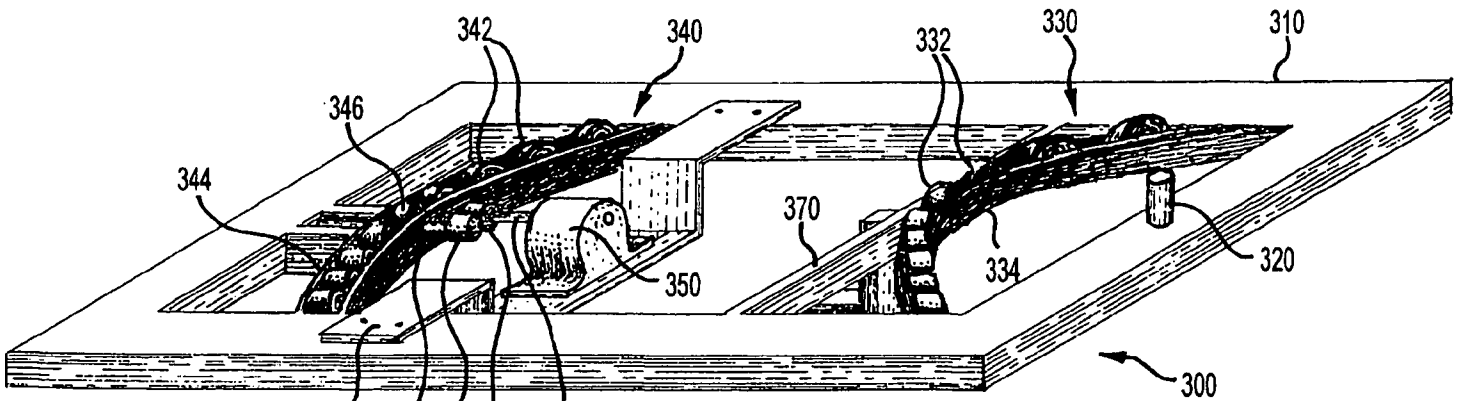
FIGS. 3A and 3B are perspective views of a first embodiment of a means for providing side-to-side motion for the bed of FIG. 1 looking from above and below; respectively.
Figure 3B:
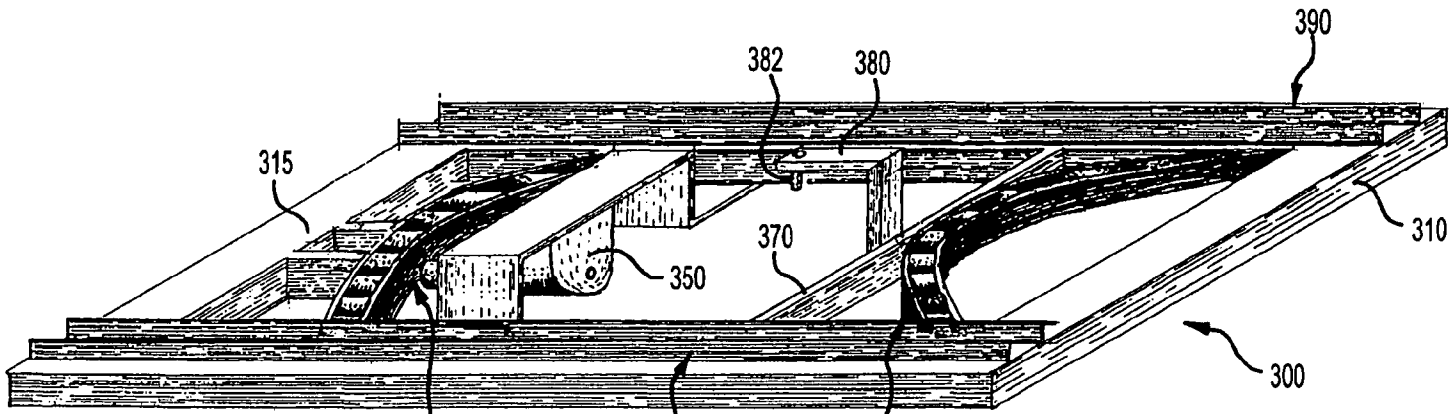

As seen in FIGS. 3A and 3B, the side-to-side motion assembly 300 includes a frame 310 that is generally rectilinear in shape. A pivot pin 320 is formed at one end of the frame 310 and is configured to cooperate with the hole 230 of the support frame 200. First and second track assemblies 330, 340 are provide inside frame 310 and the first track assembly 330 is proximal the pivot pin 320 and the second track assembly 340 is distal the pivot pin 320. First and second track assemblies 330, 340 are configured to correspond with first and second rails 240, 250, respectively.

The first track assembly 330 includes a plurality of wheels 332 supported by a rail 334. In the embodiment shown, the wheels 332 are free to rotate. The second track assembly 340 includes a plurality of wheels 342, which are supported by a rail 344. In addition to wheels 342, the second track assembly 340 also includes a drive wheel 346. Drive wheel 346 includes a pin 348 that extends through rail 344. A driven gear 349 is supported on the end of the pin 348 opposite the drive wheel 346. The driven gear 349 may be driven by an electric motor 350.

The electric motor 350 includes a drive shaft 352. A drive gear 354 is supported on the end of the drive shaft 352 and cooperates with the driven gear 349 to rotate the drive wheel 346. The electric motor 350 may be any suitable motor that allows the drive shaft to be rotated in both a forward and reverse direction. The electric motor 350 is attached to the frame 310 by a support means 360.

Frame 310 also includes a cross-member 370 that supports a linkage arm 380 and stabilizes the first track 330 that extends below frame 310. As most clearly shown in FIG. 3B, the linkage arm 380 includes a linkage pin 382. Rails 390, 395 are mounted to a lower surface 315 of the frame 310. Rails 390, 395 and linkage pin 382 cooperate with the longitudinal motion assembly 400 so that frame 310 can be displaced in a longitudinal direction with respect to foundation 500.

Figure 4:
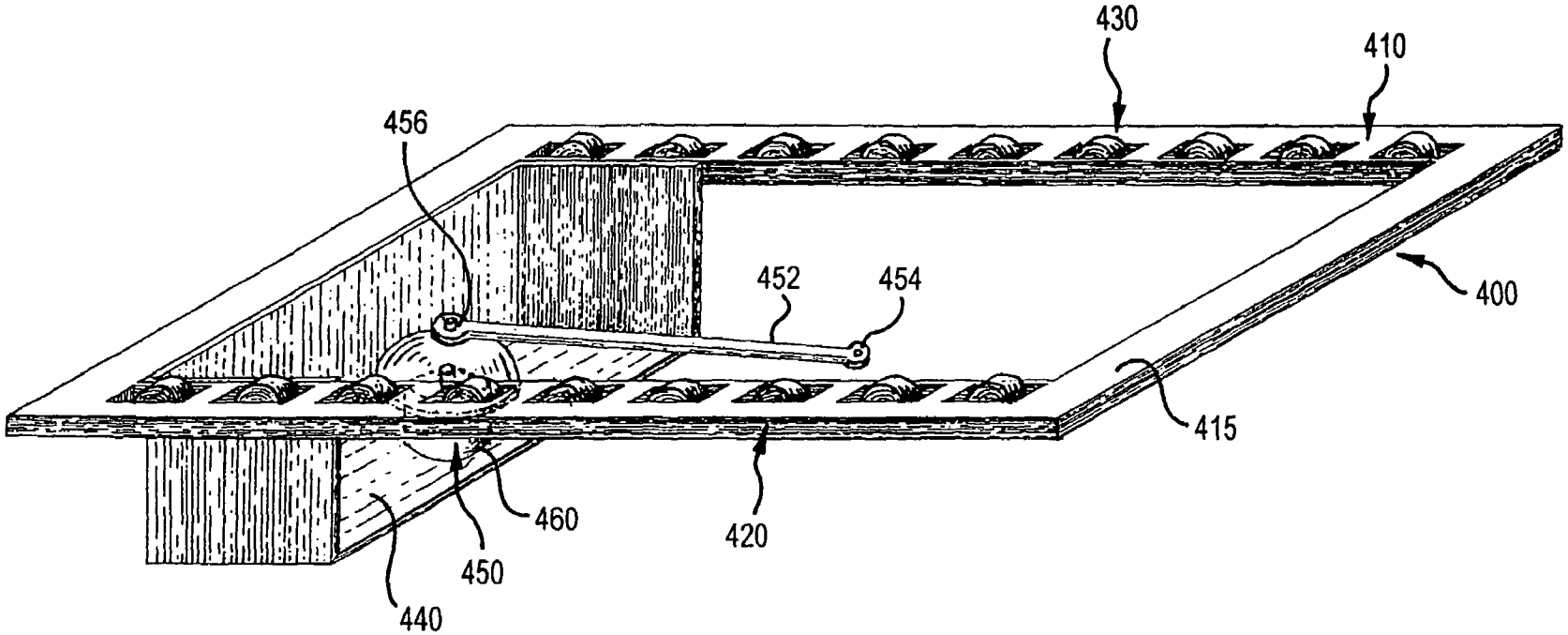
FIG. 4 is a perspective view of an exemplary embodiment of a means for providing longitudinal motion for the bed of FIG. 1.

As shown in FIG. 4, the longitudinal motion assembly 400 includes a frame 410, a first row of wheels 420, and a second row of wheels 430 formed on an upper surface 415 of the frame 410. First and second row of wheels 420, 430 cooperate with the pair of rails 390, 395, respectively, to allow frame 310 to be displaced in a longitudinal direction relative to frame 410. A support frame 440 is attached to frame 410 and supports a drive mechanism 450.

Figure 6:
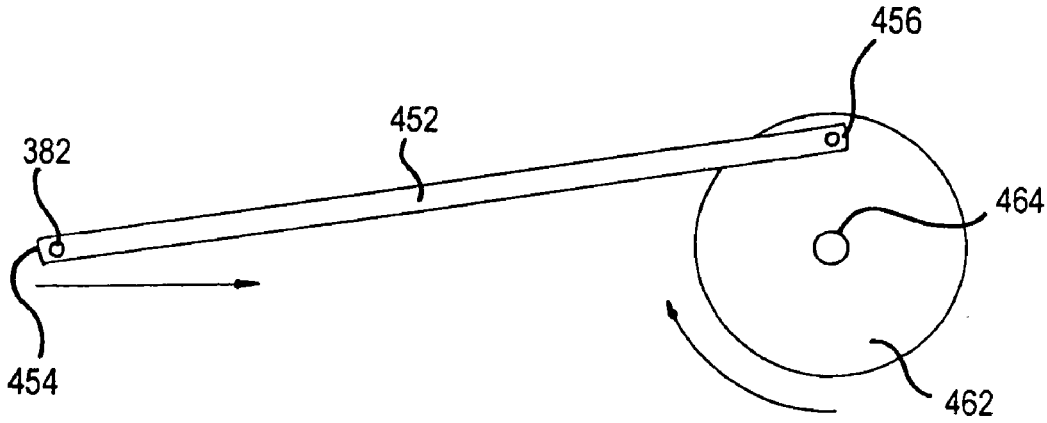
FIG. 6 is a schematic representation of the motive force of FIG. 4.

Drive mechanism 450 includes a linkage arm 452 having a first and second end 454, 456 and an electric motor 460. The first end 454 of the linkage arm 452 is connected to the linkage pin 382 of the side-to-side motion assembly 300. The second end 456 of the linkage arm 452 is connected to a disc-shaped member 462 supported on a drive shaft 464 of the electric motor 460. As seen in FIG. 4, the drive shaft 464 is preferably oriented normal to the upper surface 415 of the frame 410. In operation, as shown in FIG. 6, as the disc-shaped member 462 rotates, the linkage arm 452 is drawn in a path such that the linkage pin 382 and the frame 310 is pushed/pulled in a longitudinal direction.

Figure 5:
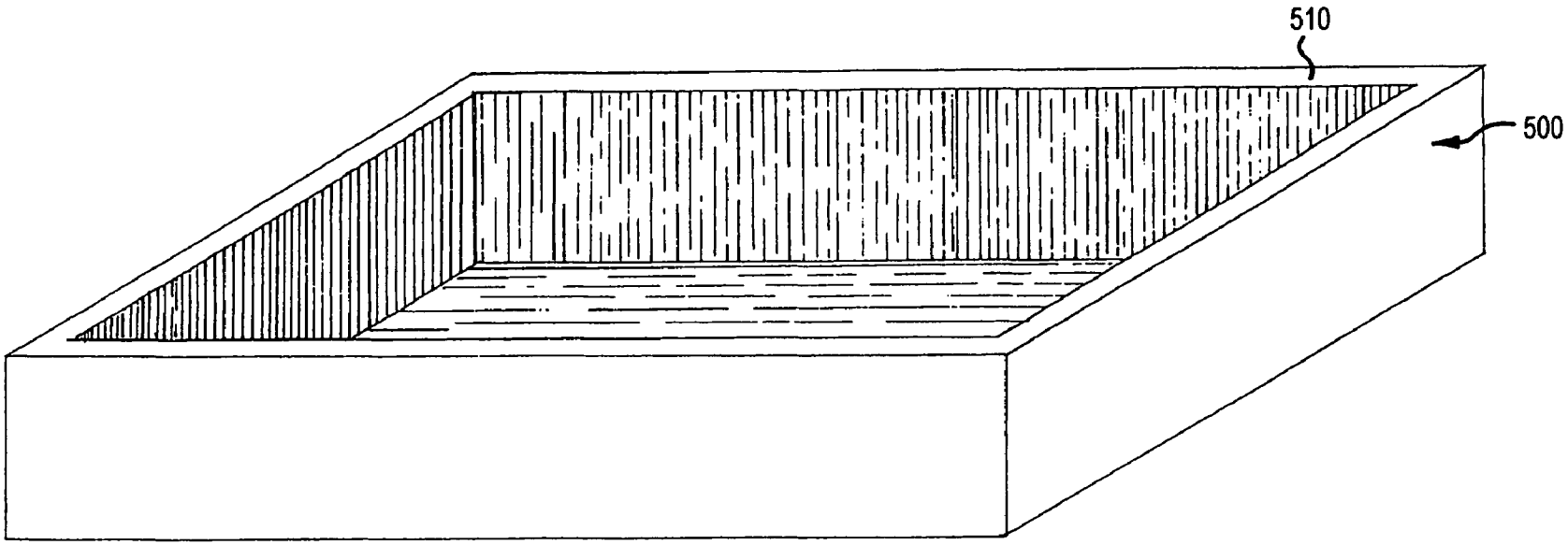
FIG. 5 is a perspective view of a foundation for the bed of FIG. 1.

The frame 410 may be fixedly attached to foundation 500. As seen in FIG. 5, the foundation 500 may be an open box 510. The box 510 conceals the drive mechanism 450 of the longitudinal motion assembly 400 and the electric motor 350 of the side-to-side motion assembly 300. Therefore, when fully assembled, the bed 10 may appear similar to any other bed arrangement.

Figure 7:
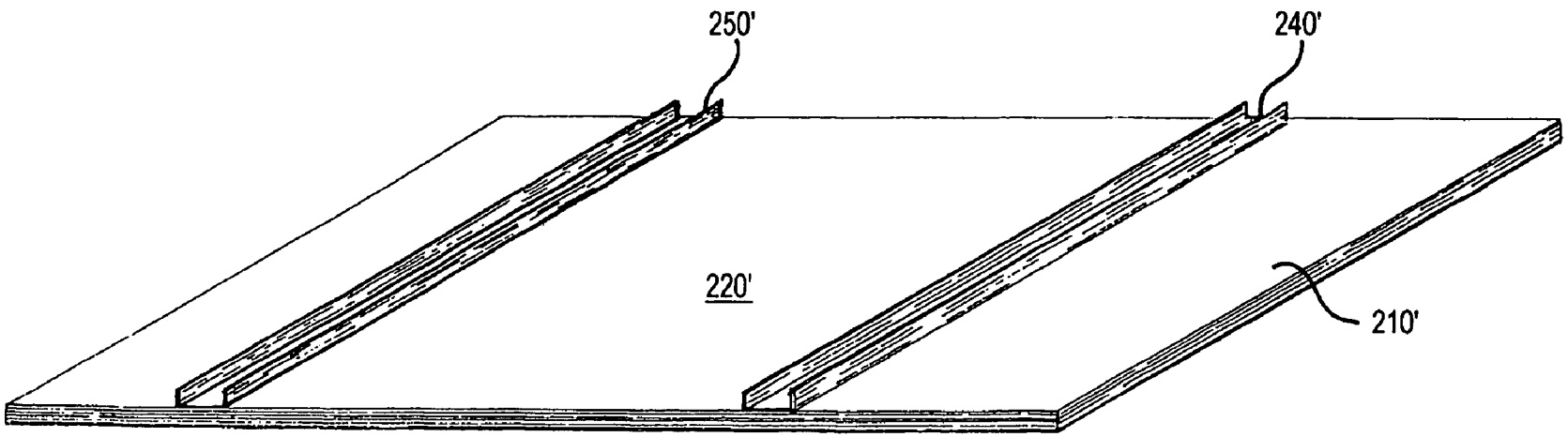
FIG. 7 is a perspective view of a second embodiment of a support frame for the bed of FIG. 1.
Figure 8A:
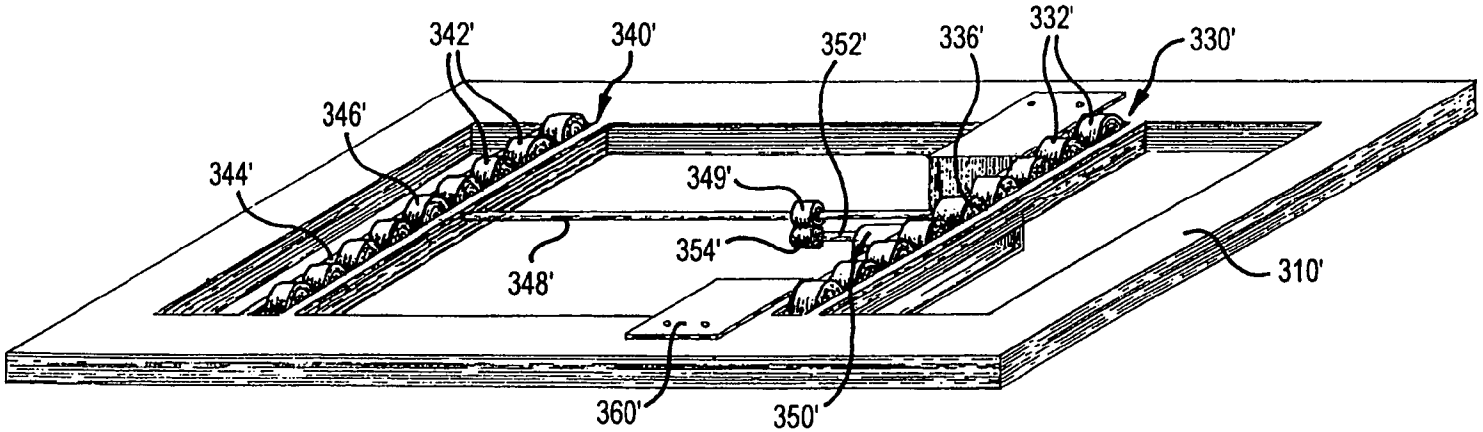
FIGS. 8A and 8B are perspective views of a second embodiment of a means for providing side-to-side motion for the bed of FIG. 1 looking from above and below; respectively.
Figure 8B:
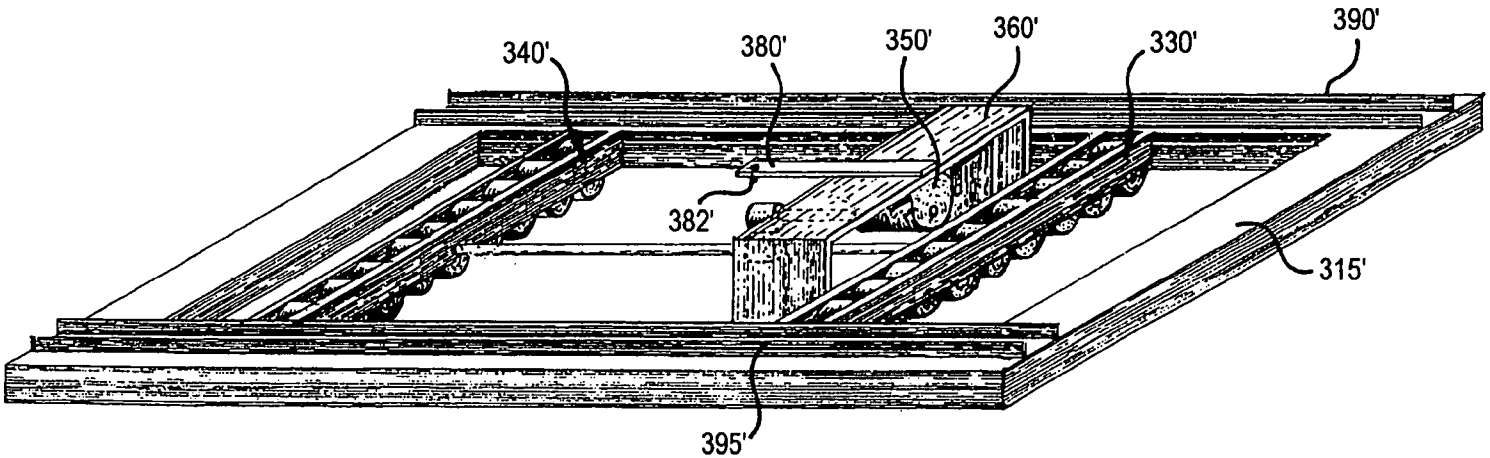

FIGS. 7, 8A, and 8B show a second exemplary embodiment of the bed of FIG. 1. In this embodiment, the support frame 200' and the side-to-side motion assembly 300' have been modified so that the entire support frame 200' translates in the transverse direction rather than pivots about a single point.

Support frame 200' is formed from any suitable planar material 210' that is strong enough to support the weight of a body or bodies plus the mattress 100. The planar material 210' has an upper surface (not shown) that contacts mattress 100 and a lower surface 220'. First and second rails 240', 250' are attached to the lower surface 220' of the planar material 210'. In this arrangement, the support frame 200' is configured to provide a side-to-side displacement with respect to the foundation 500 via an interaction between the support frame 200' and the side-to-side motion assembly 300'.

As seen in FIGS. 8A and 8B, the side-to-side motion assembly 300' includes a frame 310' that is generally rectilinear in shape. First and second track assemblies 330', 340' are provide inside frame 310'. First and second track assemblies 330', 340' are configured to correspond with first and second rails 240', 250', respectively.

The first track assembly 330' includes a plurality of wheels 332' supported by a rail 334'. A drive wheel 336' is also supported in rail 334'. The second track assembly 340' includes a plurality of wheels 342', which are supported by a rail 344'. In addition to wheels 342', the second track assembly 340' also includes a drive wheel 346'. Drive wheels 336', 346' is supported on a shaft' 348 that extends through rails 330', 340'. A driven gear 349' is supported on the shaft 348' between the first and second track assemblies 330', 340'. The driven gear 349' may be driven by an electric motor 350'.

The electric motor 350' includes a drive shaft 352'. A drive gear 354' is supported on the end of the drive shaft 352' and cooperates with the driven gear 349' to rotate the drive wheels 336', 346'. The electric motor 350' may be any suitable motor that allows the drive shaft to be rotated in both a forward and reverse direction. The electric motor 350' is attached to the frame 310' by a support means 360'.

The support means 360' supports a linkage arm 380' that extends below frame 310'. As most clearly shown in FIG. 8B, the linkage arm 380' includes a linkage pin 382'. A pair of rails 390', 395' is mounted to a lower surface 315' of the frame 310'. The pair of rails 390', 395' and linkage pin 382' cooperate with the longitudinal motion assembly 400 so that frame 310' can be displaced in a longitudinal direction with respect to foundation 500 in a similar manner as frame 310.

Figure 9A:
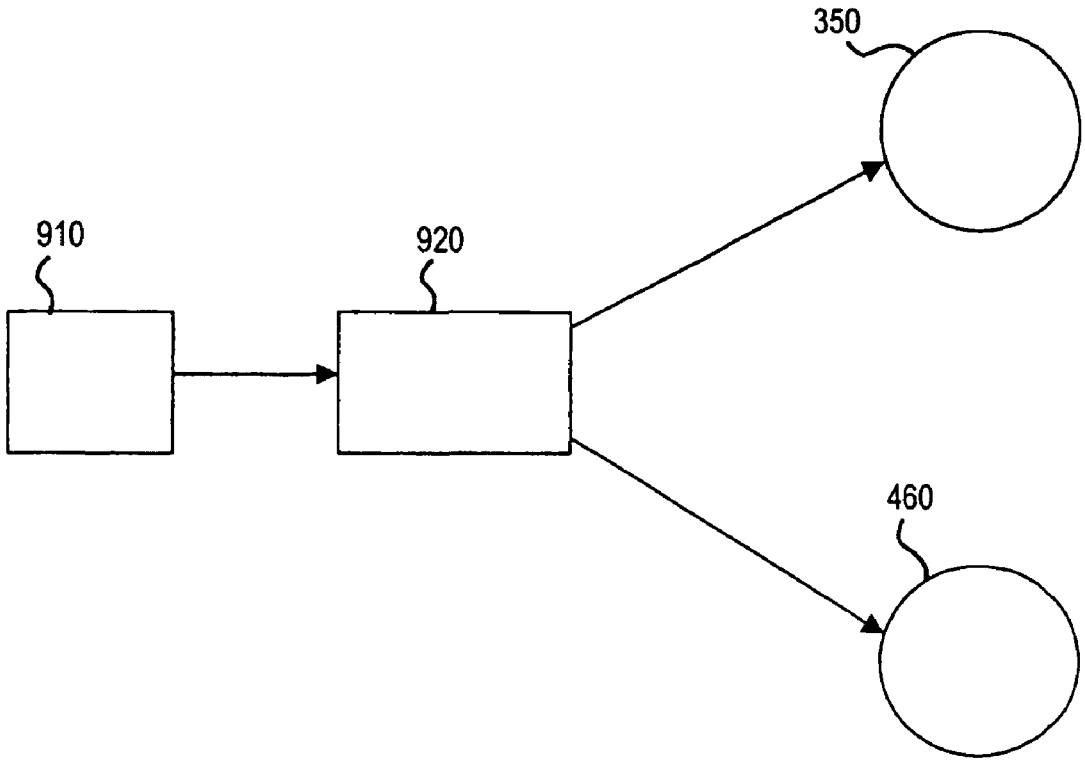
FIG. 9A is a schematic representing an exemplary control scheme for the motion of the bed of FIG. 1

In operation either exemplary embodiment of the bed 10, a user may vary the motion of the bed 10 by input parameters into a control module. FIG. 9A shows an exemplary arrangement where a user inputs control parameters into a control module 920 via user input device 910. The control module 920 sends control signals to electric motor 350 or 350' and electric motor 460. For purposes of this invention, the user may be the individual lying on the mattress 100 or an operator controlling the bed 10 for the benefit of the individual lying on the mattress 100.

Exemplary parameters include amplitude of oscillation of the support frame 200 and/or side-to-side motion assembly 300, frequency of oscillation of the support frame 200 and/or side-to-side motion assembly 300, and duration of oscillation of the support frame 200 and/or side-to-side motion assembly 300. User input device 910 may be either a control panel configured to receive user inputs or a remote device configured to transmit user inputs to control module 920. The control module 920, in turn, converts the user inputs into control signals to the appropriate electric motor(s) 350 or 350' and 460.

Figure 9B:
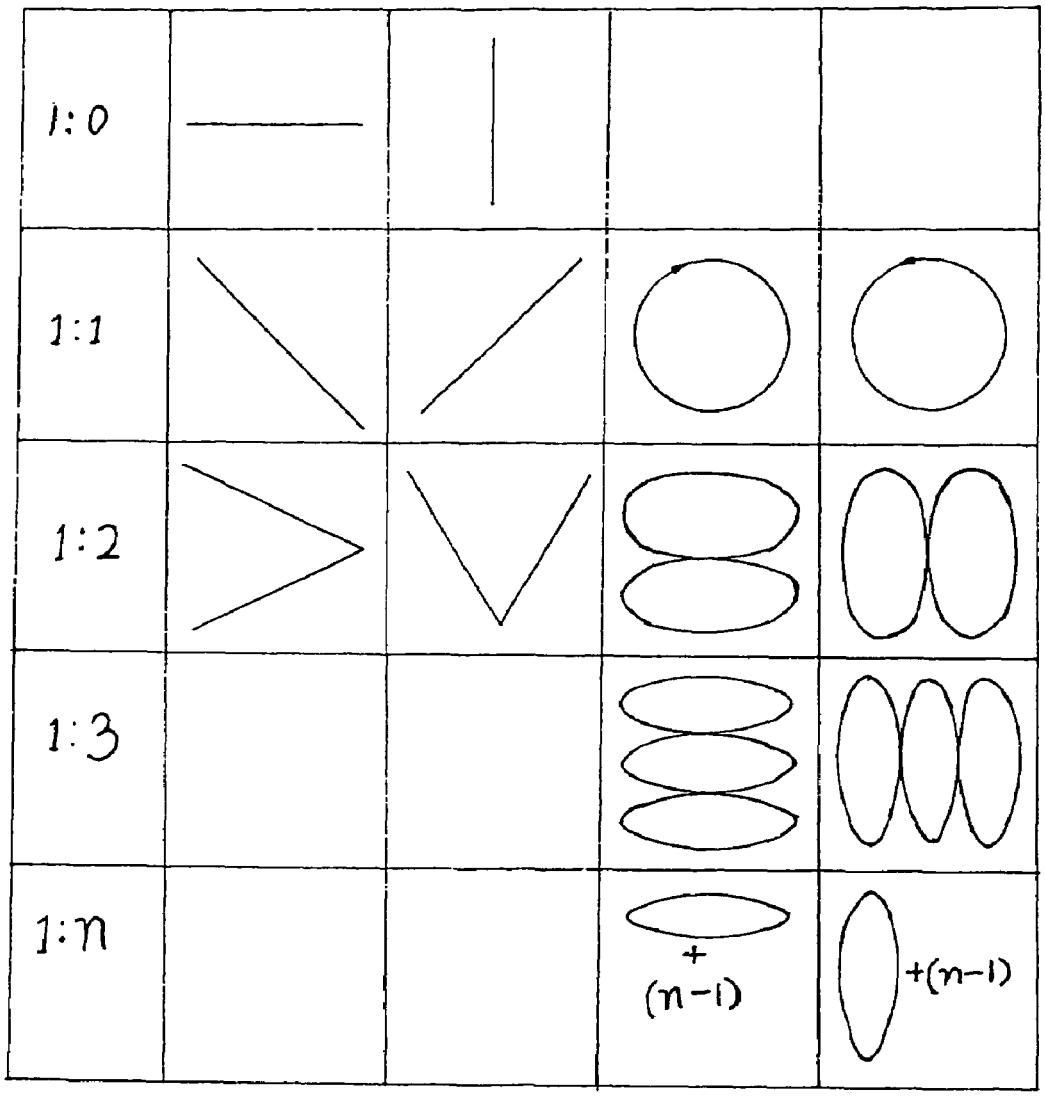
FIG. 9B shows exemplary motions of a mattress based on parameters of the control scheme.

FIG. 9B shows various oscillating motions that the bed 10 may perform based on input parameters from a user. The motion may be as simple as moving back and forth in only one direction (i.e., side-to-side or in the longitudinal direction) or in a complicated path involving many elliptical oscillations. The user may adjust the parameters to find the motion most conducive to sleep (i.e., most conducive to the sleep initiative and sleep maintenance mechanisms).

The invention thus being described, it will be obvious that the same may be varied in many ways. For example, electric motor 460 may be replaced with a linear actuator or any other device that is configured to move frame 310, 310' in a longitudinal direction. Similarly, electric motor 350, 350' may be replaced with a linear actuator that is oriented perpendicular to the drive shaft 464 of the electric motor 460/linear actuator. In addition, the arrangement of the side-to-side motion assembly 300 and the longitudinal motion assembly 400 can be reversed such that support frame 200 is supported by the longitudinal motion assembly 400. Such variations and other deviations involved in the ideology of the invention are not to be regarded as a departure from the spirit and scope of the invention, and all such modifications as would be obvious to one skilled in the art are intended to be included within the scope of the following claims.

What is claimed is:

1. An apparatus comprising:

a foundation;

a side-to-side assembly movably supported on the foundation;

a support frame movably mounted on the side-to-side assembly;

a first motion device connected to the side-to-side assembly, the first motion device configured to move the side-to-side assembly in a longitudinal direction with respect to the foundation; and a second motion device located on the side-to-side assembly, the second motion device being configured to move the support frame in a transverse direction with respect to the foundation;

wherein the combination of movement in the longitudinal direction and the transverse direction provides reciprocal movement of the support frame;

wherein the second motion device comprises:

an electric motor having a rotating shaft: and a power transmission component connected between the rotating shaft and the support frame, the power transmission component converting rotational movement of the rotating shaft into transverse displacement of the support frame, said power transmission component including a driving wheel driven by the electric motor, the driving wheel contacting a lower surface of the support frame.

2. The apparatus of claim 1 further comprising:

a control device configured to control both the first motion device and the second motion device to provide the reciprocal movement.

3. The apparatus of claim 2, wherein the control device controls a frequency of the reciprocal movement.

4. The apparatus of claim 2, wherein the control device controls amplitude of the reciprocal movement.

5. The apparatus of claim 2, wherein the control device controls a time period of the reciprocal movement.

6. The apparatus of claim 2, wherein the control device further comprises a control panel for users to set parameters of the reciprocal movement.

7. The apparatus of claim 1, wherein the first motion device comprises:

an electric motor having a rotating shaft; and a power transmission component connected between the rotating shaft and the side-to-side assembly, the power transmission component converts rotational movement of the rotating shaft into longitudinal displacement of the side-to-side assembly.

8. The apparatus of claim 1, wherein the support frame is pivotally mounted on the side-to-side assembly.

9. The apparatus of claim 1, wherein the support frame is linearly slidably mounted on the side-to-side assembly.

10. The apparatus according to claim 1, further comprising a mattress supported by the support frame.

11. The apparatus according to claim 1, further comprising a longitudinal motion assembly supporting the side-to-side assembly on the foundation, the longitudinal motion assembly being configured to provide the longitudinal displacement of the side-to-side assembly.

12. The apparatus according to claim 11, further comprising:

a pair of rails located on one of the side-to-side assembly and the longitudinal motion assembly; and a pair of track assemblies corresponding to the pair of rails located on the other of the side-to-side assembly and the longitudinal motion assembly, each of the pair of track assemblies including a plurality of wheels being movable within the corresponding rail.

13. An apparatus comprising:

a foundation;

a side-to-side assembly movably supported on the foundation;

a support frame movably mounted on the side-to-side assembly;

a first motion device connected to the side-to-side assembly, the first motion device configured to move the side-to-side assembly in a longitudinal direction with respect to the foundation:

a second motion device located on the side-to-side assembly, the second motion device being configured to move the support frame in a transverse direction with respect to the foundation:

wherein the combination of movement in the longitudinal direction and the transverse direction provides reciprocal movement of the support frame;

at least one rail located on one of the side-to-side assembly and the support frame; and at least one track assembly including a plurality of wheels located on the other of the side-to-side assembly and the support frame, the plurality of wheels being movable within the at least one rail.

14. The apparatus of claim 13, wherein the at least one rail is formed as an arcuate shape.

15. The apparatus of claim 13, wherein the at least one track assembly is formed as an arcuate shape.

16. The apparatus of claim 13, further comprising:

a pivot pin on one of the side-to-side assembly and support frame; and a hole on the other of the side-to-side assembly and support frame, the hole being configured to receive the pivot pin, wherein the support frame is configured to pivot with respect to the side-to-side assembly.

17. The apparatus according to claim 13, wherein the at least one rail includes a first rail and a second rail, the at least one track assembly includes a first track assembly and a second track assembly, and the first and second rails are generally straight.

* * * * *